US011322834B2

(12) United States Patent
Daojian et al.

(10) Patent No.: US 11,322,834 B2
(45) Date of Patent: May 3, 2022

(54) MULTI-BAND ANTENNA SYSTEM AND METHOD FOR CONTROLLING INTER-BAND INTERFERENCE IN MULTI-BAND ANTENNA SYSTEM

(71) Applicant: HUAWEI TECHNOLOGIES CO., LTD., Guangdong (CN)

(72) Inventors: Dingjiu Daojian, Dongguan (CN); Zijing Du, Xi'an (CN); Weihong Xiao, Xi'an (CN); Zhiguo Huang, Dongguan (CN); Yili Xu, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 219 days.

(21) Appl. No.: 16/696,744

(22) Filed: Nov. 26, 2019

(65) Prior Publication Data

US 2020/0099130 A1 Mar. 26, 2020

Related U.S. Application Data

(63) Continuation of application No. PCT/CN2018/089239, filed on May 31, 2018.

(30) Foreign Application Priority Data

May 31, 2017 (CN) ..... 201710401145.6

(51) Int. Cl.
*H01Q 21/26* (2006.01)
*H01Q 1/52* (2006.01)
(Continued)

(52) U.S. Cl.
CPC ..... *H01Q 1/521* (2013.01); *H01Q 1/48* (2013.01); *H01Q 5/10* (2015.01); *H01Q 5/307* (2015.01); *H01Q 5/50* (2015.01); *H01Q 15/14* (2013.01)

(58) Field of Classification Search
CPC ..... H01Q 1/521; H01Q 5/10; H01Q 5/307; H01Q 5/50; H01Q 1/48; H01Q 15/14
See application file for complete search history.

(56) References Cited

U.S. PATENT DOCUMENTS

2005/0093746 A1 5/2005 Diament
2014/0374616 A1 12/2014 Larussi et al.
(Continued)

FOREIGN PATENT DOCUMENTS

CN 1572045 A 1/2005
CN 201174424 Y 12/2008
(Continued)

OTHER PUBLICATIONS

Extended European Search Report issued in European Application No. 18809449.4 dated Apr. 7, 2020, 9 pages.
(Continued)

*Primary Examiner* — Dieu Hien T Duong
(74) *Attorney, Agent, or Firm* — Fish & Richardson P.C.

(57) ABSTRACT

A multi-band antenna system and a method for controlling inter-band interference in the multi-band antenna system are provided. The multi-band antenna system includes at least one first radiating element and at least one second radiating element. An operating frequency band of the first radiating element is higher than an operating frequency band of the second radiating element. Each first radiating element includes a grounding structure, a balun, and at least two radiation arms. One end of the balun is electrically connected to the at least two radiation arms. The balun includes at least one conductive structure. The balun is configured to: after obtaining a differential mode signal, input the differential mode signal to the grounding structure using the at least one conductive structure. The differential mode signal
(Continued)

is a signal obtained by the balun by sensing a signal from the second radiating element in a differential mode manner.

19 Claims, 9 Drawing Sheets

(51) Int. Cl.

| | |
|---|---|
| ***H01Q 5/10*** | (2015.01) |
| ***H01Q 5/307*** | (2015.01) |
| ***H01Q 5/50*** | (2015.01) |
| ***H01Q 1/48*** | (2006.01) |
| *H01Q 15/14* | (2006.01) |

(56) References Cited

U.S. PATENT DOCUMENTS

| | | | | |
|---|---|---|---|---|
| 2015/0102962 | A1 | 4/2015 | Ellgardt | |
| 2016/0285169 | A1* | 9/2016 | Shooshtari ..... | H01Q 21/062 |
| 2018/0351246 | A1 | 12/2018 | Yu et al. | |

FOREIGN PATENT DOCUMENTS

| | | | |
|---|---|---|---|
| CN | 101944649 | A | 1/2011 |
| CN | 102868017 | A | 1/2013 |
| CN | 104064867 | A | 9/2014 |
| CN | 104106179 | A | 10/2014 |
| CN | 105576378 | A | 5/2016 |
| CN | 105960737 | A | 9/2016 |
| CN | 106025555 | A | 10/2016 |
| CN | 107359418 | A | 11/2017 |
| WO | 2015107473 | A1 | 7/2015 |

OTHER PUBLICATIONS

Office Action issued in Chinese Application No. 201710401145.6 dated Mar. 21, 2019, 12 pages (with English translation).
Office Action issued in Chinese Application No. 201710401145.6 dated Sep. 4, 2019, 6 pages (with English translation).
PCT International Search Report and Written Opinion issued in International Application No. PCT/CN2018/089239 dated Jul. 27, 2018, 15 pages (with English translation).

* cited by examiner

MULTI-BAND ANTENNA SYSTEM AND METHOD FOR CONTROLLING INTER-BAND INTERFERENCE IN MULTI-BAND ANTENNA SYSTEM

CROSS-REFERENCE TO RELATED APPLICATIONS

This application is a continuation of International Application No. PCT/CN2018/089239, filed on May 31, 2018, which claims priority to Chinese Patent Application No. 201710401145.6, filed on May 31, 2017. The disclosures of the aforementioned applications are hereby incorporated by reference in their entireties.

TECHNICAL FIELD

This application relates to the field of antenna technologies, and in particular, to a multi-band antenna system and a method for controlling inter-band interference in the multi-band antenna system.

BACKGROUND

In a multi-band antenna system shown in FIG. 1, radiating elements in different frequency bands may be deployed. For a schematic structural diagram of a radiating element, refer to FIG. 2. If two radiating elements (for example, a high-band radiating element and a low-band radiating element) that use different frequency bands operate at a same time, a radiation arm of the high-band radiating element obtains, through sensing, a low frequency signal transmitted by the low-band radiating element. After the low frequency signal is obtained through sensing by using a feed plate of the high-band radiating element, the low frequency signal may be transmitted from one radiation arm of the high-band radiating element to another radiation arm of the high-band radiating element. In this way, the following problem is caused: An induced current in a same frequency band as the low frequency signal is formed between radiation arms of the high-band radiating element. The induced current generates differential mode radiation, and the differential mode radiation generated by the induced current is superposed on low-band radiation, used as a source, of the low-band radiating element. Consequently, normal operating of the low-band radiating element is interfered, to be specific, an antenna pattern may be distorted.

SUMMARY

This application provides a multi-band antenna system and a method for controlling inter-band interference in the multi-band antenna system, to avoid inter-band interference generated when radiating elements in different frequency bands in the multi-band antenna system operates at a same time in the prior art.

According to a first aspect of this application, a multi-band antenna system is provided. The multi-band antenna system includes at least one first radiating element and at least one second radiating element. An operating frequency band of the first radiating element is higher than an operating frequency band of the second radiating element. Each first radiating element includes a grounding structure, a balun, and at least two radiation arms, and one end of the balun is electrically connected to the at least two radiation arms. The balun includes at least one conductive structure.

The balun is configured to: after obtaining a differential mode signal, input the differential mode signal to the grounding structure by using the at least one conductive structure. The differential mode signal is a signal obtained by the balun by sensing a signal from the second radiating element in a differential mode manner.

Optionally, the operating frequency band used by the first radiating element and that used by the second radiating element in this application may be in a frequency multiplication relationship, and a multiple of the operating frequency bands is not limited in this application.

Compared with the prior art, in the solution provided in this application, because the at least one conductive structure is disposed in the balun in the first radiating element, after obtaining the differential mode signal, the balun can input the differential mode signal to the grounding structure by using the at least one conductive structure. In this way, the differential mode signal does not flow into the radiation arm of the first radiating element. Correspondingly, the differential mode signal does not generate differential mode radiation between radiation arms of the first radiating element, so that inter-band interference can be reduced, and differential mode resonance intensity of the second radiating element within the operating frequency band of the second radiating element decreases. Therefore, it can be ensured that the first radiating element operates normally, and the second radiating element also operates normally. For a high-band radiating element, after obtaining a low frequency signal of a low-band radiating element, because the high-band radiating element uses the balun structure, in other words, the high-band radiating element can block backflow of the low frequency signal between the radiation arms, the high-band radiating element finally eliminates the differential mode radiation caused by the low frequency signal. In this way, an antenna pattern of the low-band radiating element is not interfered, and a radiation gain of the low-band radiating element is further increased.

In this application, the balun further includes a transport layer of a feed signal, a signal ground layer, and a microstrip. Both the transport layer of the feed signal and the signal ground layer are electrically connected to the grounding structure. The transport layer of the feed signal is electrically connected to the signal ground layer, and the microstrip is electrically connected to the grounding structure. The following two manners are mainly used to suppress differential mode resonance.

1. Introduce a Short-Circuit Stub to the Balun

A. Introduce the short-circuit stub to the transport layer of the feed signal, and use the short-circuit stub and the microstrip as the foregoing conductive structure. When the conductive structure includes the short-circuit stub and the microstrip, the transport layer of the feed signal is used to: after obtaining the differential mode signal, input the differential mode signal to the microstrip by using the at least one short-circuit stub.

The microstrip is configured to input, to the grounding structure, the differential mode signal input from the transport layer of the feed signal.

In this application, the transport layer of the feed signal includes an impedance conversion section and a coupling section. The impedance conversion section includes a transmission section and a feed section. In this application, a total quantity of deployed short-circuit stubs and a quantity of short-circuit stubs respectively deployed on the transmission section, the feed section, or the coupling section is not limited. The following describes deployment of a short-circuit stub.

In some possible designs, the short-circuit stub is disposed on the transmission section. When the at least one short-circuit stub is electrically connected to the transmission section, the differential mode signal flows from the transmission section and the feed section into the microstrip.

In some possible designs, the short-circuit stub is disposed on the feed section. When the at least one short-circuit stub is electrically connected to the feed section, the differential mode signal flows from the feed section into the microstrip.

In some possible designs, the short-circuit stub is disposed on the coupling section. When the at least one short-circuit stub is electrically connected to the coupling section, the differential mode signal flows from the coupling section and the feed section into the microstrip.

In some possible designs, the short-circuit stub is disposed on at least two of the transmission section, the feed section, or the coupling section. For example, the short-circuit stub is separately disposed on the transmission section and the coupling section, or the short-circuit stub is separately disposed on the feed section and the coupling section, or the short-circuit stub is separately disposed on the transmission section, the feed section, and the coupling section. In this circuit structure, a signal trend of the differential mode signal may include at least one of the following three types:

The differential mode signal flows from the transmission section and the feed section into the microstrip.

Alternatively, the differential mode signal flows from the coupling section and the feed section into the microstrip.

Alternatively, the differential mode signal flows from the feed section into the microstrip.

B. Introduce the short-circuit stub to the transport layer of the feed signal, and use the short-circuit stub as the conductive structure.

One end of the short-circuit stub is electrically connected to the transport layer of the feed signal, and the other end of the short-circuit stub is electrically connected to the grounding structure.

The transport layer of the feed signal is used to: after obtaining the differential mode signal, divert the differential mode signal from the transport layer of the feed signal to the grounding structure by using the at least one short-circuit stub.

Likewise, in an embodiment in which the short-circuit stub is used as the conductive structure, and the differential mode signal is diverted to the grounding structure by using the short-circuit stub, the short-circuit stub may also be separately disposed on at least one of the transmission section, the feed section, or the coupling section.

2. Introduce a Plated Through Hole to the Balun

Specifically, the plated through hole is introduced to the transport layer of the feed signal, and the plated through hole and the microstrip are used as the conductive structure. The plated through hole may be disposed at a stub of the feed section. FIG. 8 is a schematic structural diagram when the plated through hole is disposed at the transport layer of the feed signal.

Correspondingly, the transport layer of the feed signal may be used to: after obtaining the differential mode signal, input the differential mode signal to the microstrip by using the plated through hole.

The microstrip is configured to input, to the grounding structure, the differential mode signal input from the transport layer of the feed signal. Specifically, the differential mode signal flows from the transmission section and the feed section into the microstrip.

It can be learned that in any one of circuit structures in the foregoing description, after the first radiating element obtains, through sensing, the differential mode signal of the second radiating element, differential mode resonance formed due to the differential mode signal on the first radiating element can be destroyed. For the second radiating element, radiation that is generated when the second radiating element is operating receives significantly less radiation interference from the first radiating element, and even does not receive radiation interference from the first radiating element. In addition, a radiation gain of the second radiating element does not deteriorate due to differential mode resonance. In comparison with an existing mechanism, the radiation gain of the second radiating element can be significantly increased.

In some possible designs, an antenna element on the first radiating element is a half-wave dipole, to weaken impact on the differential mode resonance for the second radiating element, and ensure radiation efficiency of the first radiating element. Further, a length of the radiation arm of the first radiating element, a height of the balun of the first radiating element, or a length of the short-circuit stub may be set. The height of the balun may be set to Y, where Y=L/4. The height of the balun is set to L/4 because a current on the radiation arm is parallel to a reflection apparatus. Due to the reflection apparatus, an equivalent mirror current having a mirror symmetry along the reflection apparatus in an opposite direction is generated. When the radiation arm is L/4 away from the reflection apparatus, the current on the radiation arm and the image current may be superposed in a same phase at a far field, thereby improving antenna performance.

Alternatively, the length of the radiation arm is set to L/4, so that a total length of the two radiation arms is L/2, and maximum radiation efficiency can be finally implemented.

Alternatively, the length of the short-circuit stub may be set to X, where X=n=(L/4), L is a wavelength corresponding to a center frequency of the operating frequency band of the first radiating element, and n is a positive integer less than or equal to 4.

According to a second aspect of this application, a method for controlling inter-band interference in a multi-band antenna system is provided. The multi-band antenna system includes at least one first radiating element and at least one second radiating element, and an operating frequency band of the first radiating element is higher than an operating frequency band of the second radiating element. Optionally, the operating frequency band used by the first radiating element and that used by the second radiating element in this application may be in a frequency multiplication relationship, and a multiple of the operating frequency bands is not limited in this application.

Each first radiating element includes a grounding structure, a balun, and at least two radiation arms, one end of the balun is electrically connected to the at least two radiation arms, and the balun includes at least one conductive structure. The method includes:

after obtaining a differential mode signal, transferring, by the balun, the differential mode signal to the grounding structure by using the at least one conductive structure, where the differential mode signal is a signal obtained by the balun by sensing a signal from the second radiating element in a differential mode manner.

Compared with the prior art, in the solution provided in this application, because the at least one conductive structure is disposed in the balun in the first radiating element, after obtaining the differential mode signal, the balun can input the differential mode signal to the grounding structure by using the at least one conductive structure. In this way, the differential mode signal does not flow into the radiation arm of the first radiating element. Correspondingly, the differential mode signal does not generate differential mode radiation between radiation arms of the first radiating element, so that inter-band interference can be reduced, and differential mode resonance intensity of the second radiating element within the operating frequency band of the second radiating element decreases. Therefore, it can be ensured that the first radiating element operates normally, and the second radiating element also operates normally. For a high-band radiating element, after obtaining a low frequency signal of a low-band radiating element, the high-band radiating element can block backflow of the low frequency signal between the radiation arms, the high-band radiating element finally eliminates the differential mode radiation caused by the low frequency signal. In this way, an antenna pattern of the low-band radiating element is not interfered, and a radiation gain of the low-band radiating element is further increased.

In some possible designs, the balun further includes a transport layer of a feed signal, the conductive structure includes a short-circuit stub and a microstrip, and the microstrip is electrically connected to the grounding structure.

The transferring the differential mode signal to the grounding structure by using the at least one conductive structure includes:

inputting, by the transport layer of the feed signal, the differential mode signal to the microstrip by using the at least one short-circuit stub; and inputting, by the microstrip to the grounding structure, the differential mode signal input from the transport layer of the feed signal. By using this solution, differential mode resonance can be effectively suppressed.

In some possible designs, the transport layer of the feed signal includes an impedance conversion section. The impedance conversion section includes a transmission section and a feed section.

When the at least one short-circuit stub is electrically connected to the transmission section, the differential mode signal flows from the transmission section and the feed section into the microstrip.

Alternatively, when the at least one short-circuit stub is electrically connected to the feed section, the differential mode signal flows from the feed section into the microstrip. By using this solution, differential mode resonance can be effectively suppressed.

In some possible designs, the transport layer of the feed signal includes an impedance conversion section and a coupling section. The impedance conversion section includes a feed section, and the at least one short-circuit stub is electrically connected to the coupling section.

The differential mode signal flows from the coupling section and the feed section into the microstrip.

In some possible designs, the transport layer of the feed signal includes an impedance conversion section and a coupling section. The coupling section and the impedance conversion section each are electrically connected to the at least one short-circuit stub, and the impedance conversion section includes a transmission section and a feed section. In this circuit structure, the differential mode signal flows in the following three main directions:

The differential mode signal flows from the transmission section and the feed section into the microstrip.

Alternatively, the differential mode signal flows from the coupling section and the feed section into the microstrip.

Alternatively, the differential mode signal flows from the feed section into the microstrip. It can be learned that after diverted to the microstrip, the differential mode signal may flow into the grounding structure over the microstrip. Finally, differential mode resonance is effectively suppressed.

In some possible designs, the balun further includes a transport layer of a feed signal. The conductive structure includes a short-circuit stub. One end of the short-circuit stub is electrically connected to the transport layer of the feed signal, and the other end of the short-circuit stub is electrically connected to the grounding structure.

The transferring the differential mode signal to the grounding structure by using the at least one conductive structure includes:

after obtaining the differential mode signal from the second radiating element, diverting, by the transport layer of the feed signal, the differential mode signal from the transport layer of the feed signal to the grounding structure by using the at least one short-circuit stub. It can be learned that by using this solution, differential mode resonance can be effectively suppressed.

In some possible designs, the balun further includes a transport layer of a teed signal. The conductive structure includes a microstrip and a plated through hole. The plated through hole is disposed at a stub of the feed section, and the microstrip is electrically connected to the grounding structure.

The transferring the differential mode signal to the grounding structure by using the at least one conductive structure includes:

after obtaining the differential mode signal, inputting, by the transport layer of the feed signal, the differential mode signal to the microstrip by using the plated through hole; and inputting, by the microstrip to the grounding structure, the differential mode signal input from the transport layer of the feed signal. It can be learned that after diverted to the microstrip, the differential mode signal may flow into the grounding structure over the microstrip. Finally, differential mode resonance is effectively suppressed.

In some possible designs, the transport layer of the feed signal includes an impedance conversion section. The impedance conversion section includes a transmission section and a feed section. The plated through hole is disposed at the stub of the feed section.

The differential mode signal flows from the transmission section and the feed section into the microstrip. It can be learned that after diverted to the microstrip, the differential mode signal may flow into the grounding structure over the microstrip. Finally, differential mode resonance is effectively suppressed.

In some possible designs, a length of the short-circuit stub is X, where $X=n\times(L/4)$, L is a wavelength corresponding to a center frequency of the operating frequency band of the first radiating element, and n is a positive integer less than or equal to 4. For a low frequency signal, the L/4 short-circuit stub is not an L/4 open circuit line. Therefore, when a low-frequency differential mode signal flows into the first radiating element, R of an entire short-circuit stub decreases. Therefore, the low-frequency differential mode signal may flow to the GND along the microstrip, instead of flowing into the radiation arm of the first radiating element, to further eliminate differential mode resonance.

Compared with the prior art, in the solution provided in this application, because the at least one conductive structure is disposed in the balun in the first radiating element, after obtaining the differential mode signal, the balun can input the differential mode signal to the grounding structure by using the at least one conductive structure. In this way, the differential mode signal does not flow into the radiation arm of the first radiating element. Correspondingly, the differential mode signal does not generate differential mode radiation between radiation arms of the first radiating element, so that inter-band interference can be reduced, and differential mode resonance intensity of the second radiating element within the operating frequency band of the second radiating element decreases. Therefore, it can be ensured that the first radiating element operates normally, and the second radiating element also operates normally.

DESCRIPTION OF EMBODIMENTS

In the specification, claims, and accompanying drawings of this application, the terms "first", "second", and so on are intended to distinguish between similar objects but do not necessarily indicate a specific order or sequence. It should be understood that data used in such a way is interchangeable in a proper circumstance, so that the embodiments described herein can be implemented in an order other than the order illustrated or described herein. In addition, the terms "include", "have", and any variant thereof are intended to cover non-exclusive inclusion. For example, a process, a method, a system, a product, or a device that includes a series of steps or modules is not necessarily limited to the steps or modules that are expressly listed, but may include another step or module not expressly listed or inherent to the process, the method, the product, or the device. The module division in this application is merely logical division, and there may be other division during implementation in actual application. For example, a plurality of modules may be combined or integrated into another system, or some features may be ignored or not performed. In addition, the displayed or discussed mutual couplings or direct couplings or communication connections may be implemented through some interfaces. Indirect couplings or communication connections between the modules may be implemented in an electronic or another form, and this is not limited in this application. In addition, modules or sub-modules described as separate components may be or may not be physically separated, or may be or may not be physical modules, or may not be distributed into a plurality of circuit modules. Objectives of the solutions of this application may be achieved by selecting some or all of the modules based on an actual requirement.

Figure 1:
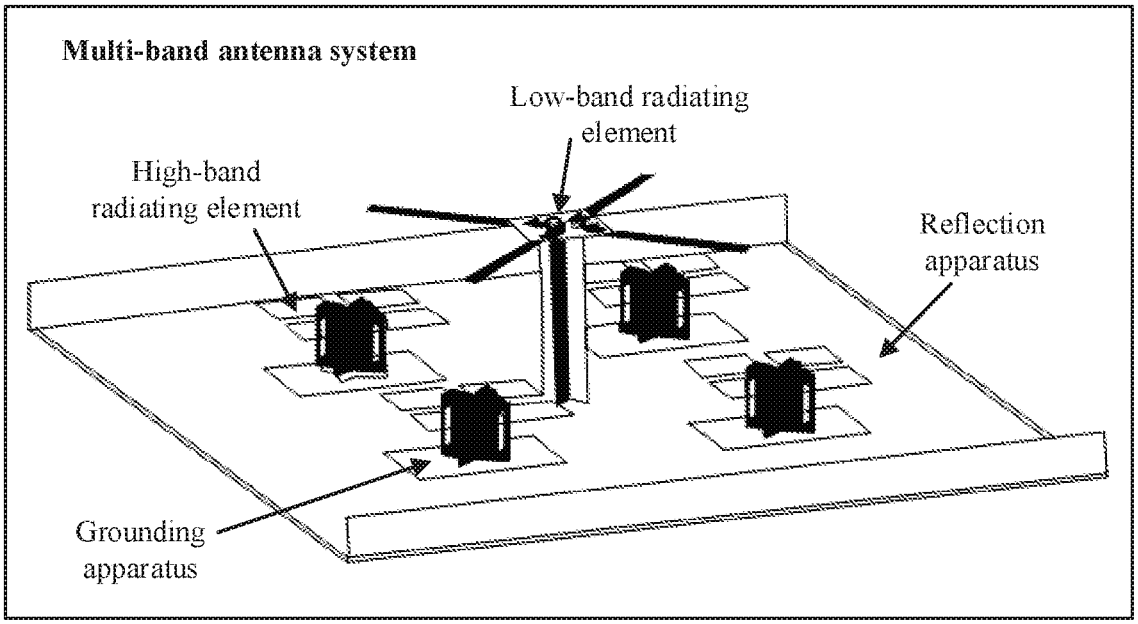
FIG. 1 is a schematic structural diagram of a multi-band antenna system according to an embodiment of the present invention.
Figure 2:
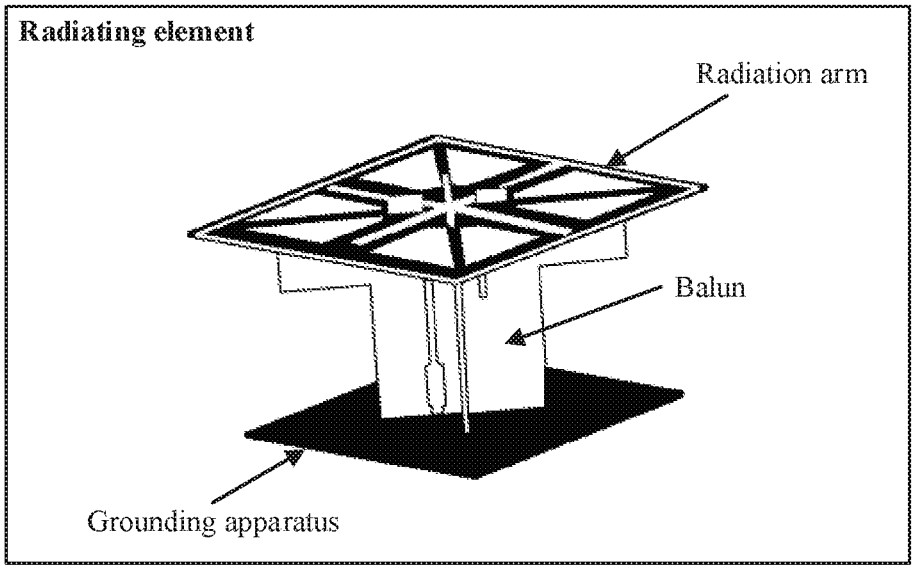
FIG. 2 is a schematic structural diagram of a radiating element in a multi-band antenna system in an existing mechanism.
Figure 3:
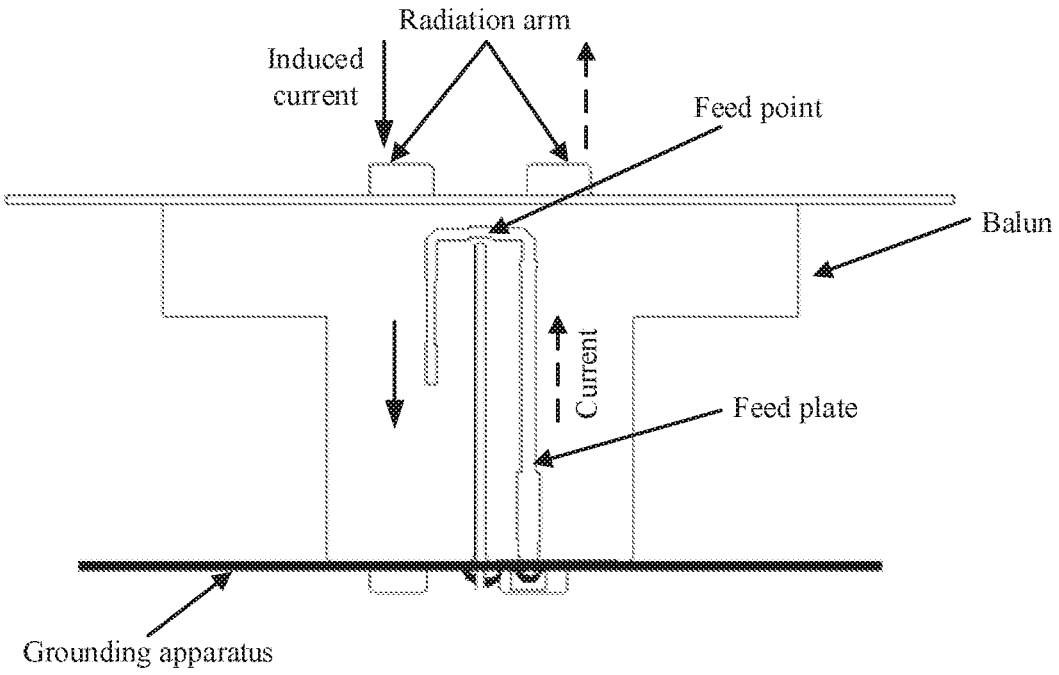
FIG. 3 is another schematic structural diagram of a radiating element in a multi-band antenna system in an existing mechanism.
Figure 4:
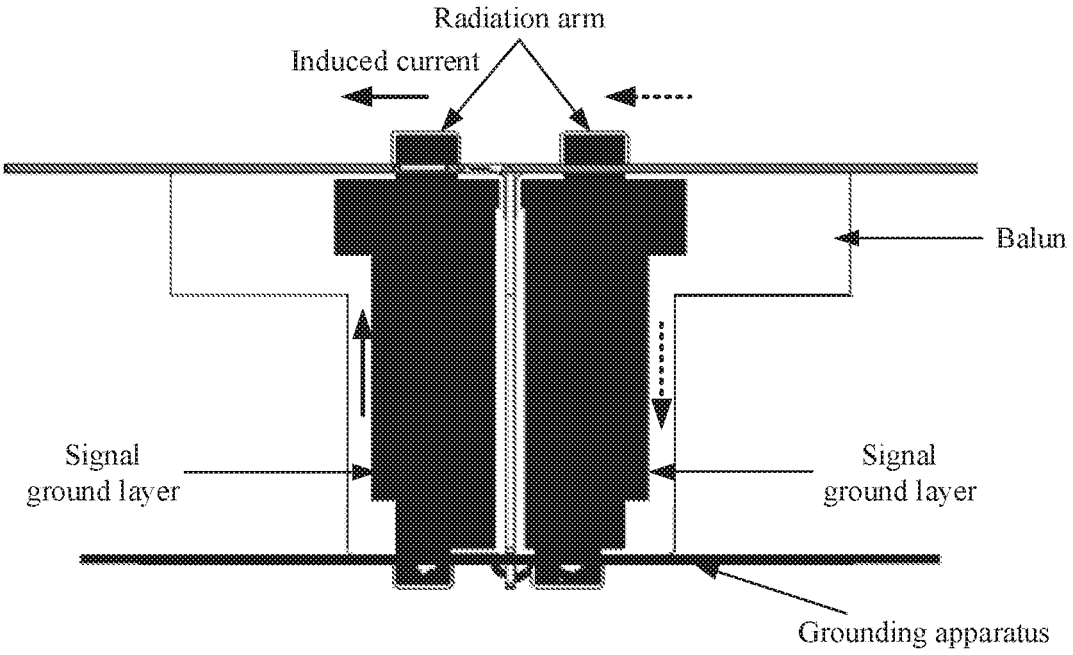
FIG. 4 is another schematic structural diagram of a radiating element in a multi-band antenna system in an existing mechanism.

This application provides a multi-band antenna system and a method for controlling inter-band interference in the multi-band antenna system, applicable to the field of antenna technologies. Detailed descriptions are provided below. The multi-band antenna system in this application includes a radiation arm, a balun, and a reflection apparatus. The balun refers to a balanced to unbalanced transformer, and the balun has functions of matching an unbalanced coaxial cable with a balanced dipole antenna, suppressing a common mode current, eliminating common-mode interference, and transforming impedance. FIG. 3 is a schematic structural diagram of one side of a common balun, and FIG. 4 is a schematic structural diagram of another side of the common balun. A balun includes a feed plate, a microstrip, and a grounding structure. In FIG. 3, a signal on a right side of the feed plate flows in a direction indicated by dashed line arrows (flowing upward), and a signal on a left side of the feed plate flows in a direction indicated by solid line arrows (flowing downward). The feed plate is separated, by using a medium, from a signal ground layer corresponding to the feed plate, and therefore currents on two signal ground layers are in an inverted phase. When the currents are in the inverted phase, radiation is offset.

However, because the radiation arm and the signal ground layers are electrically conductive and a current is continuous, signals on two radiation arms are in a same phase, and when the signals on the two radiation arms are in the same phase, radiation is enhanced. It can be teamed that due to the feed plate structure in the balun, when a high-band radiating element is operating, if a nearby low-band radiating element is also operating, a radiation arm of the high-band radiating element obtains, through sensing, a corresponding low frequency signal. The low frequency signal may be transmitted from one radiation arm of the high-band radiating element to another radiation arm of the high-band radiating element by using a feed plate of the high-band radiating element, and may not directly flow into a grounding apparatus. In this way, an induced current in a same frequency band as the low frequency signal is formed between high-band radiation arms. This induced current generates differential mode radiation, and the differential mode radiation generated by the induced current is superposed on low-band radiation, used as a source, of the low-band radiating element. Consequently, normal operating of the low-band radiating element is interfered, and an antenna pattern may be distorted. It can be learned that the low frequency signal sensed by the high-band radiating element may be transmitted from one radiation arm to another radiation arm by using the feed plate of the high-band radiating element, to form the differential mode radiation, and the antenna pattern of the low-band radiating element is distorted.

To resolve the foregoing technical problem, this application mainly provides the following technical solutions:

A short-circuit stub may be introduced into a feed structure of the high-band radiating element, to divert a sensed differential mode signal to the grounding apparatus. Alternatively, a plated through hole is introduced into the feed structure of the high-band radiating element, to directly connect to a transport layer of a feed signal and the signal ground layer, so that the differential mode signal flows from a feed point to the microstrip, and finally flows from the microstrip to the grounding apparatus. In both of the two manners, differential mode radiation cannot be excited between the radiation arms of the high-band radiating element. Consequently, intensity of parasitic resonance generated in a low-band radiating element that has a relatively low operating frequency band decreases, and finally an antenna array of the low-band radiating element can operate normally.

Figure 5:
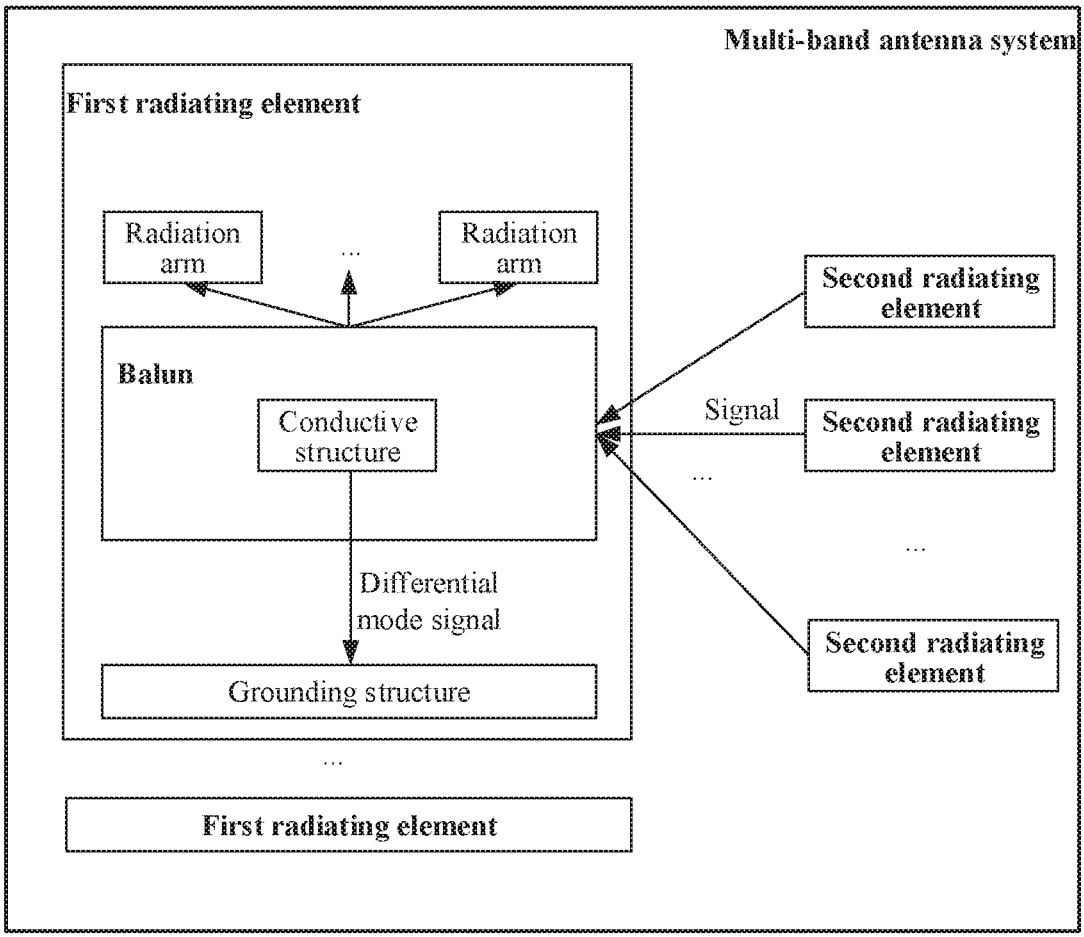
FIG. 5 is a schematic structural diagram of a multi-band antenna system according to an embodiment of the present invention.

Referring to FIG. 5, the following uses an example to describe a structure of a multi-band antenna system provided in this application. The multi-band antenna system may include at least one first radiating element and at least one second radiating element. An operating frequency band of the first radiating element is higher than an operating frequency band of the second radiating element. The first radiating element and the second radiating element have different frequencies. When the first radiating element is operating, and nearby second radiation is also operating, this high-band element receives a signal of the second radiating element in two manners: a differential mode and a common mode. The following uses an example in which the first radiating element senses a differential mode signal of the second radiating element and suppresses flowing of the sensed differential mode signal into radiation arms of the first radiating element.

Each first radiating element includes a grounding structure, a balun, and at least two radiation arms. One end of the balun is electrically connected to the at least two radiation arms. The balun includes at least one conductive structure.

The balun is configured to: after obtaining a differential mode signal, input the differential mode signal to the grounding structure by using the at least one conductive structure. The differential mode signal is a signal obtained by the balun by sensing a signal from the second radiating element in a differential mode manner.

Optionally, the operating frequency band used by the first radiating element and that used by the second radiating element in this application may be in a frequency multiplication relationship, and a multiple of the operating frequency bands is not limited in this application.

Compared with the prior art, in the solution provided in this application, because the at least one conductive structure is disposed in the balun in the first radiating element, after obtaining the differential mode signal, the balun can input the differential mode signal to the grounding structure by using the at least one conductive structure. In this way, the differential mode signal does not flow into the radiation arm of the first radiating element. Correspondingly, the differential mode signal does not generate differential mode radiation between radiation arms of the first radiating element, so that inter-band interference can be reduced, and differential mode resonance intensity of the second radiating element within the operating frequency band of the second radiating element decreases. Therefore, it can be ensured that the first radiating element operates normally, and the second radiating element also operates normally. For a high-band radiating element, after obtaining a low frequency signal of a low-band radiating element, because the high-band radiating element uses the balun structure shown in FIG. 5 of this application, in other words, the high-band radiating element can block backflow of the low frequency signal between the radiation arms, the high-band radiating element finally eliminates the differential mode radiation caused by the low frequency signal. In this way, an antenna pattern of the low-band radiating element is not interfered, and a radiation gain of the low-band radiating element is further increased.

In this application, the balun further includes a transport layer of a feed signal, a signal ground layer, and a microstrip. Both the transport layer of the feed signal and the signal ground layer are electrically connected to the grounding structure. The transport layer of the teed signal is electrically connected to the signal ground layer, and the microstrip is electrically connected to the grounding structure. The following two manners are mainly used to suppress differential mode resonance.

1. Introduce a Short-Circuit Stub to the Balun

A. Introduce the short-circuit stub to the transport layer of the feed signal, and use the short-circuit stub and the microstrip as the conductive structure. When the conductive structure includes the short-circuit stub and the microstrip, the transport layer of the feed signal is used to: after obtaining the differential mode signal from the second radiating element, input the differential mode signal to the microstrip by using at least one short-circuit stub.

The microstrip is configured to input, to the grounding structure, the differential mode signal input from the transport layer of the feed signal.

In this application, the transport, layer of the feed signal includes an impedance conversion section and a coupling section. The impedance conversion section includes a transmission section and a feed section. In this application, a total quantity of deployed short-circuit stubs and a quantity of short-circuit stubs respectively deployed on the transmission section, the feed section, or the coupling section is not limited. The following describes deployment of a short-circuit stub.

(1) Dispose the Short-Circuit Stub on the Transmission Section.

Figure 6A:
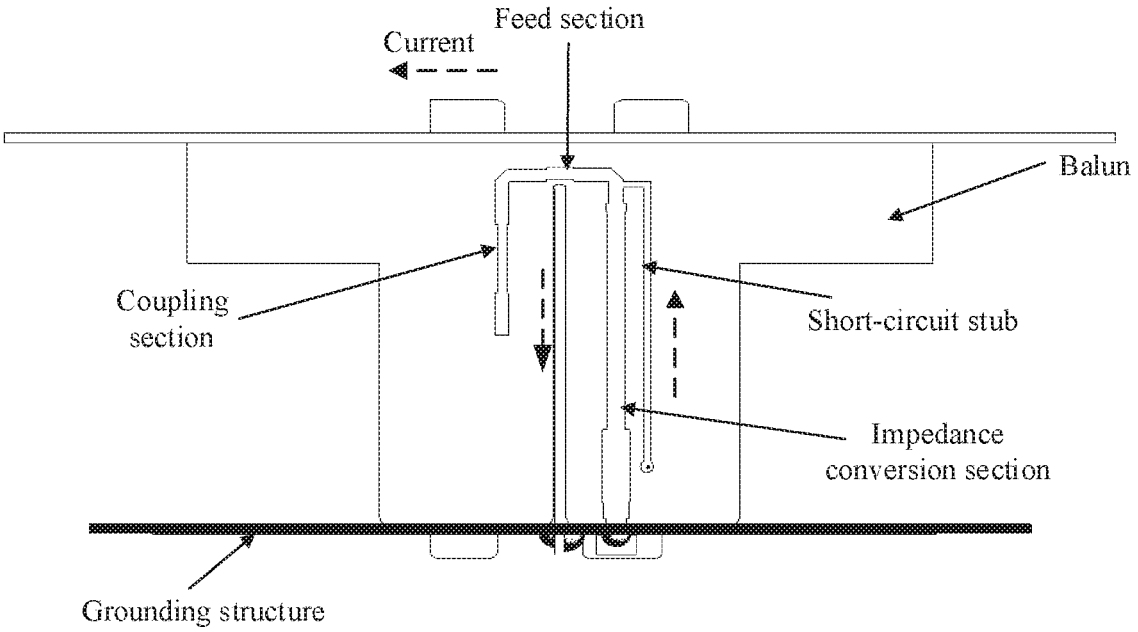
FIG. 6*a* is a schematic structural diagram of a first radiating element according to an embodiment of the present invention.

When the at least one short-circuit stub is electrically connected to the transmission section, the differential mode signal flows from the transmission section and the feed section into the microstrip. FIG. 6*a* is a schematic structural diagram when the short-circuit stub is disposed on the transmission section.

(2) Dispose the Short-Circuit Stub on the Feed Section.

Figure 6B:
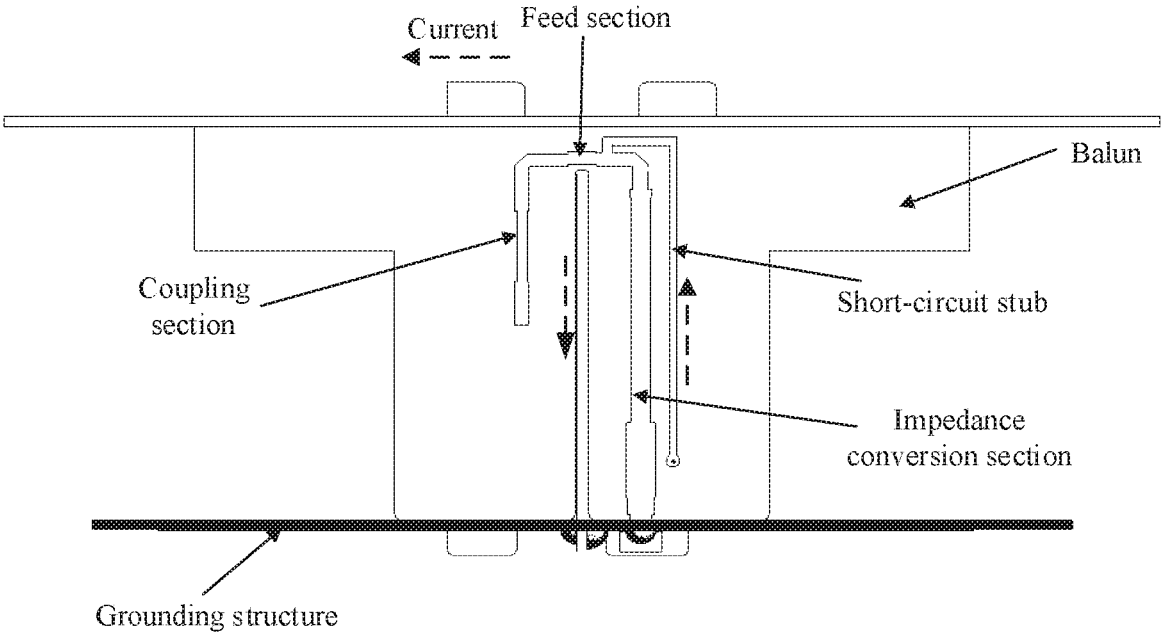
FIG. 6*b* is another schematic structural diagram of a first radiating element according to an embodiment of the present invention.

When the at least one short-circuit stub is electrically connected to the feed section, the differential mode signal flows from the feed section into the microstrip. FIG. 6*b* is a schematic structural diagram when the short-circuit stub is disposed on the feed section.

(3) Dispose the Short-Circuit Stub on the Coupling Section.

Figure 6C:
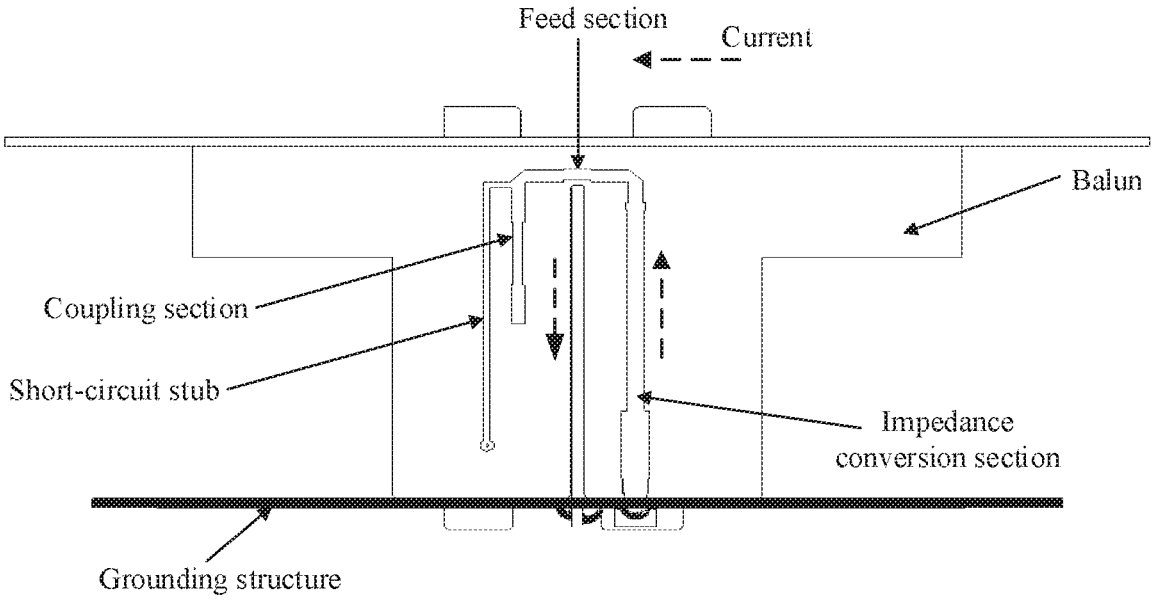
FIG. 6*c* is another schematic structural diagram of a first radiating element according to an embodiment of the present invention.

When the at least one short-circuit stub is electrically connected to the coupling section, the differential mode signal flows from the coupling section and the feed section into the microstrip. FIG. 6*c* is a schematic structural diagram when the short-circuit stub is disposed on the coupling section.

(4) Dispose the Short-Circuit Stub on at Least Two of the Transmission Section, the Feed Section, or the Coupling Section.

Figure 6D:
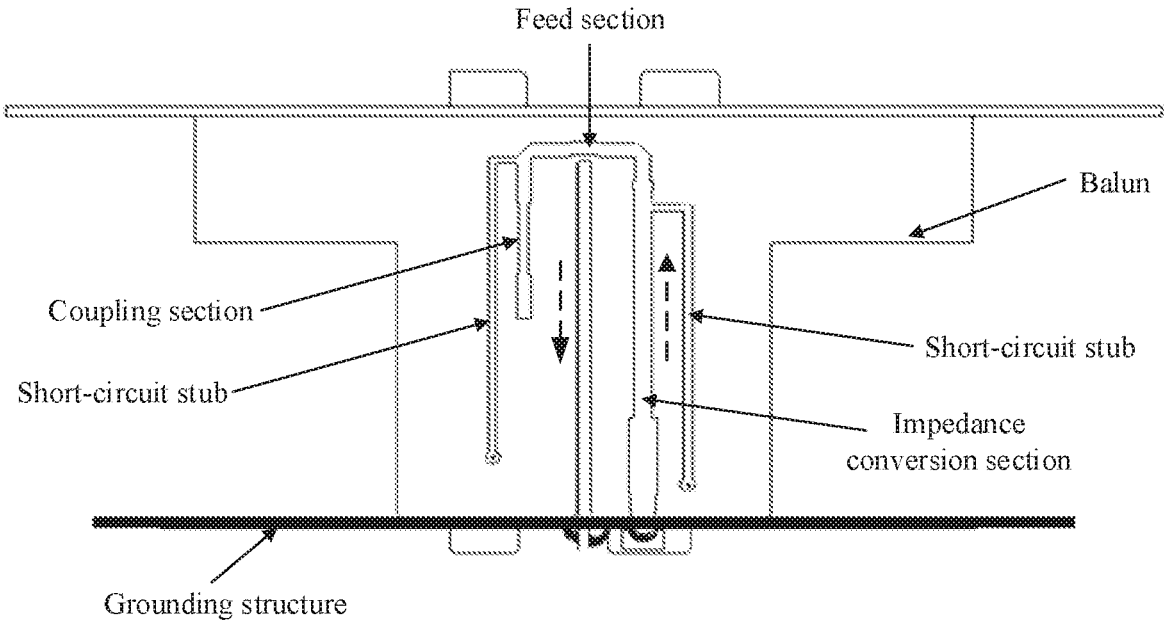
FIG. 6*d* is another schematic structural diagram of a first radiating element according to an embodiment of the present invention.
Figure 6E:
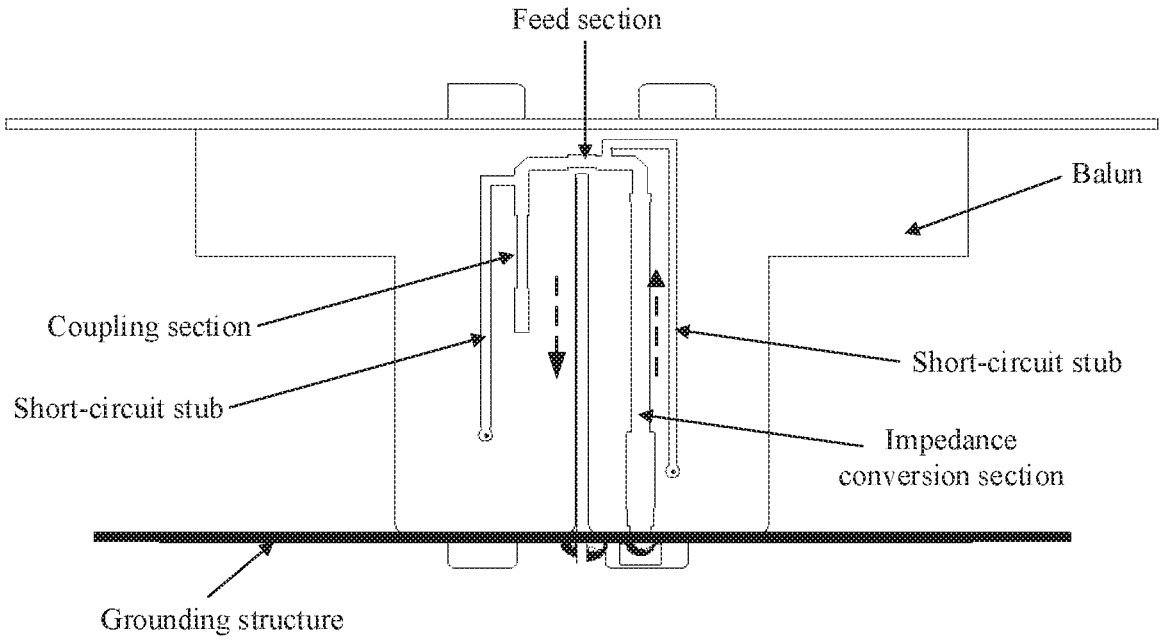
FIG. 6*e* is another schematic structural diagram of a first radiating element according to an embodiment of the present invention.
Figure 6F:
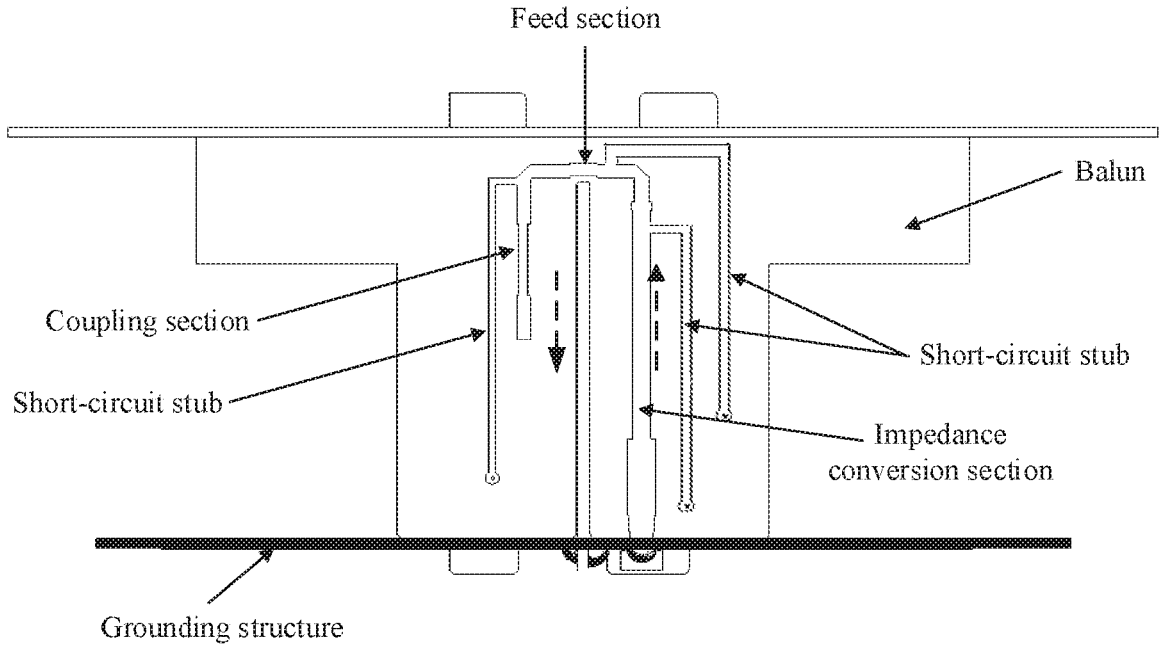
FIG. 6*f* is another schematic structural diagram of a first radiating element according to an embodiment of the present invention.

For example, the short-circuit stub is separately disposed on the transmission section and the coupling section (as shown in FIG. 6*d*), or the short-circuit stub is separately disposed on the feed section and the coupling section (as shown in FIG. 6*e*), or the short-circuit stub is separately disposed on the transmission section, the feed section, and the coupling section (as shown in FIG. 6*f*).

In this circuit structure in (4), a signal trend of the differential mode signal may include at least one of the following three types:

The differential mode signal flows from the transmission section and the feed section into the microstrip.

Alternatively, the differential mode signal flows from the coupling section and the feed section into the microstrip.

Alternatively, the differential mode signal flows from the feed section into the microstrip.

B. Introduce the short-circuit stub to the transport layer of the feed signal, and use the short-circuit stub as the conductive structure.

One end of the short-circuit stub is electrically connected to the transport layer of the feed signal, and the other end of the short-circuit stub is electrically connected to the grounding structure.

The transport layer of the feed signal is used to: after obtaining the differential mode signal, divert the differential mode signal from the transport layer of the feed signal to the grounding structure by using the at least one short-circuit stub, so that the differential mode signal cannot generate an induced current between the radiation arms of the first radiating element. In this way, differential mode resonance is not generated for the second radiating element, and a radiation gain of the second radiating element can be further increased without a need to greatly modify an original balun structure and to reduce an entire integration level of the balun.

Figure 7A:
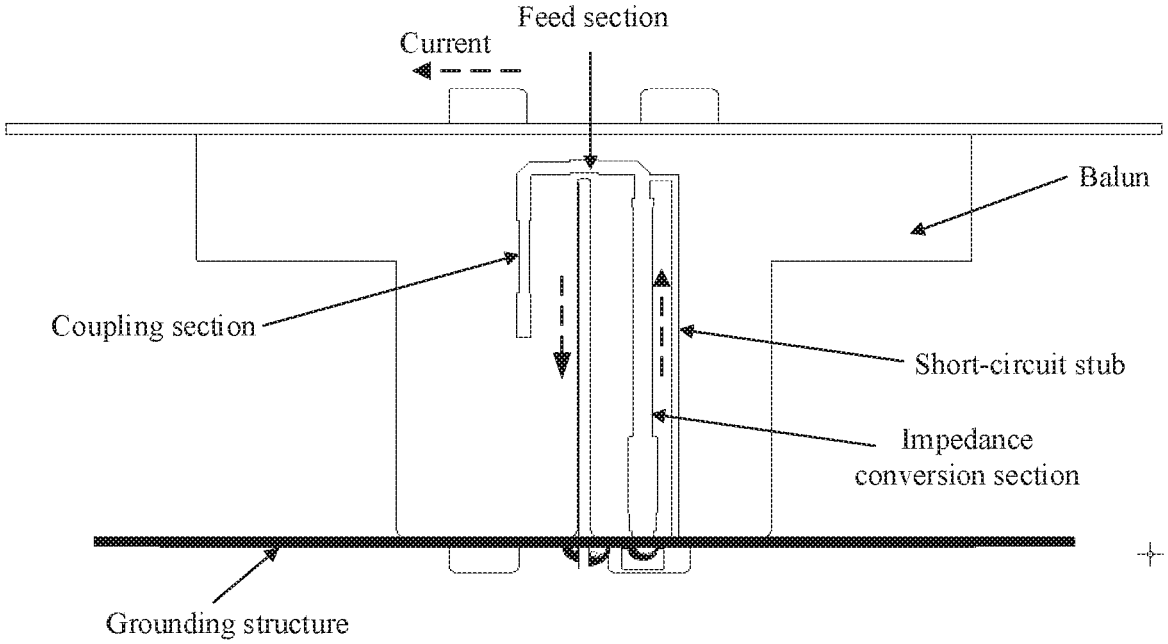
FIG. 7*a* is another schematic structural diagram of a first radiating element according to an embodiment of the present invention.
Figure 7B:
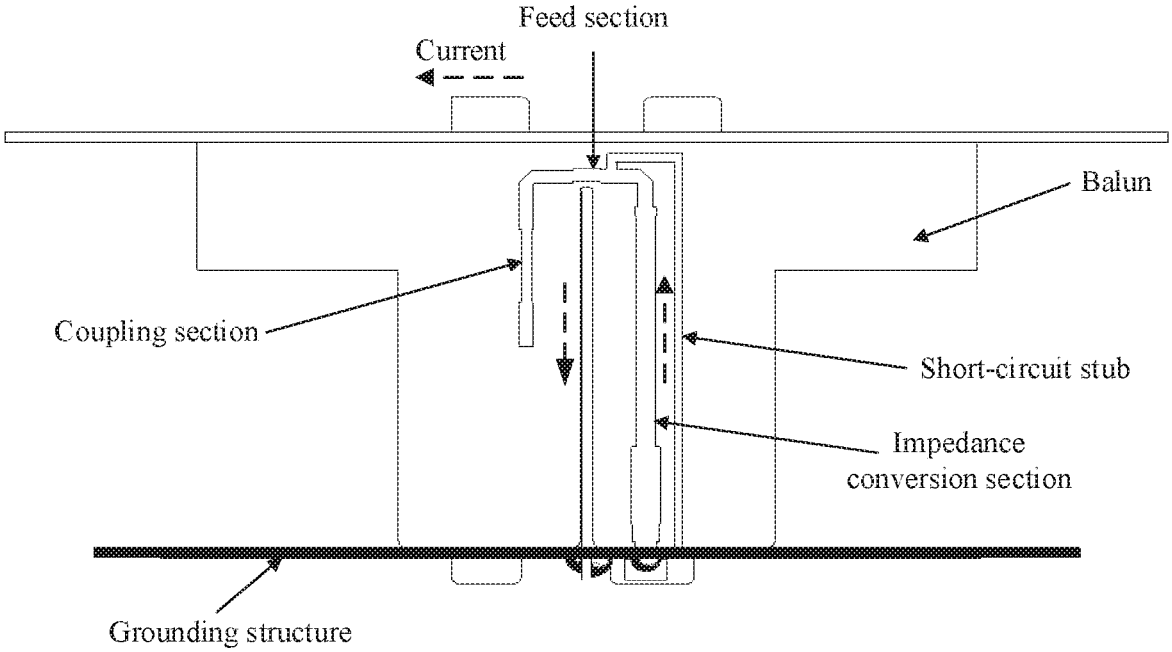
FIG. 7*b* is another schematic structural diagram of a first radiating element according to an embodiment of the present invention.
Figure 7C:
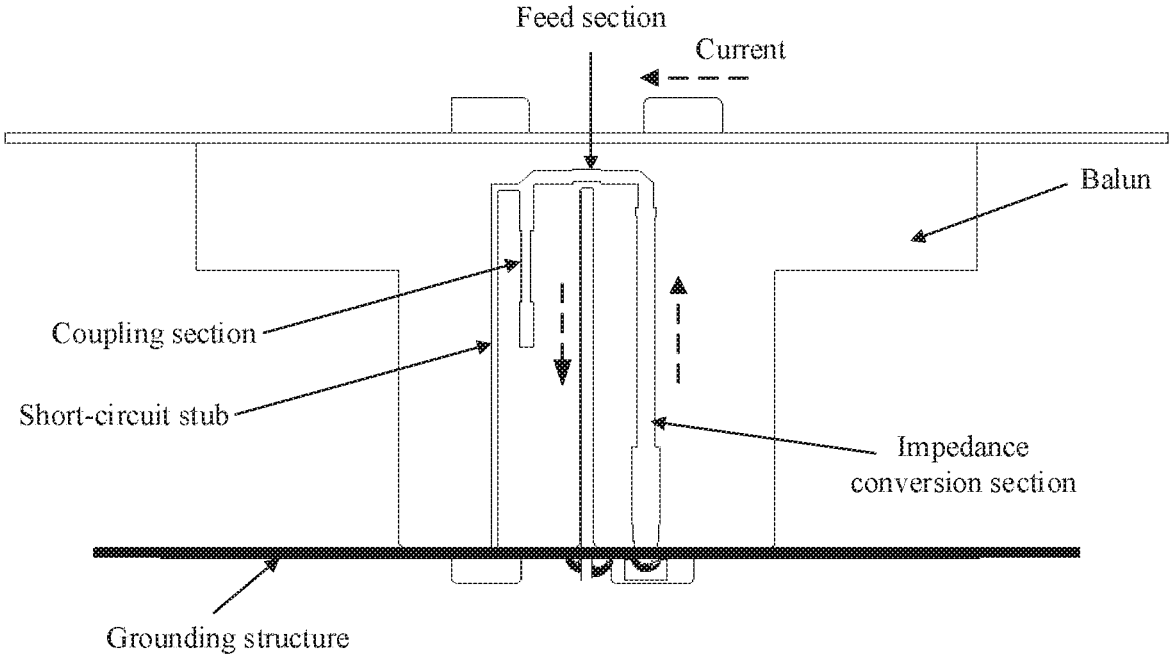
FIG. 7*c* is another schematic structural diagram of a first radiating element according to an embodiment of the present invention.

Likewise, in an embodiment in which the short-circuit stub is used as the conductive structure, and the differential mode signal is diverted to the grounding structure by using the short-circuit stub, the short-circuit stub may also be separately disposed on at least one of the transmission section, the feed section, or the coupling section. For a specific schematic structural diagram, refer to structural diagrams shown in FIG. 7*a*, FIG. 7*b*, and FIG. 7*c*. In FIG. 7*a*, the short-circuit stub is disposed on the transmission section of the transport layer of the feed signal. In FIG. 7*b*, the short-circuit stub is disposed on the feed section of the transport layer of the feed signal. In FIG. 7*c*, the short-circuit stub is disposed on the coupling section of the transport layer of the feed signal.

Optionally, in some embodiments of the invention, an antenna element on the first radiating element is a half-wave dipole, to weaken impact on the differential mode resonance for the second radiating element, and ensure radiation efficiency of the first radiating element. Further, a length of the radiation arm of the first radiating element, a height of the balun of the first radiating element, or a length of the short-circuit stub may be set.

For example, the height of the balun may be set to Y, where Y=L/4. The height of the balun is set to L/4 because a current on the radiation arm is parallel to a reflection apparatus. Due to the reflection apparatus, an equivalent mirror current having a mirror symmetry along the reflection apparatus in an opposite direction is generated. When the radiation arm is L/4 away from the reflection apparatus, the current on the radiation arm and the image current in a same phase may be superposed at a far field, thereby improving antenna performance.

Alternatively, the length of the radiation arm is set to L4, so that a total length of the two radiation arms is L/2, and maximum radiation efficiency can be finally implemented.

For example, the length of the short-circuit stub may alternatively be set to X, where X=n×(L/4), L is a wavelength corresponding to a center frequency of the operating frequency band of the first radiating element, and n is a positive integer less than or equal to 4. For example, when n=1, the length of the short-circuit stub is L/4, and the L/4 short-circuit stub considers impedance conversion of the transport layer of the feed signal. After L/4 conversion of the short-circuit stub on the entire transport layer of the feed signal, when a differential mode signal whose operating frequency is higher than that of a first high radiating element is obtained through sensing, a node impedance characteristic of the entire transport layer of the feed signal is an open circuit. Therefore, for a high frequency signal, the short-circuit stub of this length is equivalent to a short-circuit stub whose resistance is in a high resistance status, and is equivalent to an open circuit line. Therefore, a high-frequency differential mode signal cannot flow into the transport layer of the feed signal, but can only flow back between radiation arms at a top of the balun.

However, for a low frequency signal, the short-circuit stub is not an L/4 open circuit line. Therefore, when a low-frequency differential mode signal flows into the first radiating element, a resistance of an entire short-circuit stub decreases. Therefore, the low-frequency differential mode signal may flow to the grounding structure along the microstrip, instead of flowing into the radiation arm of the first radiating element, to further eliminate differential mode resonance.

2. Introduce a Plated Through Hole to the Balun

Figure 8:
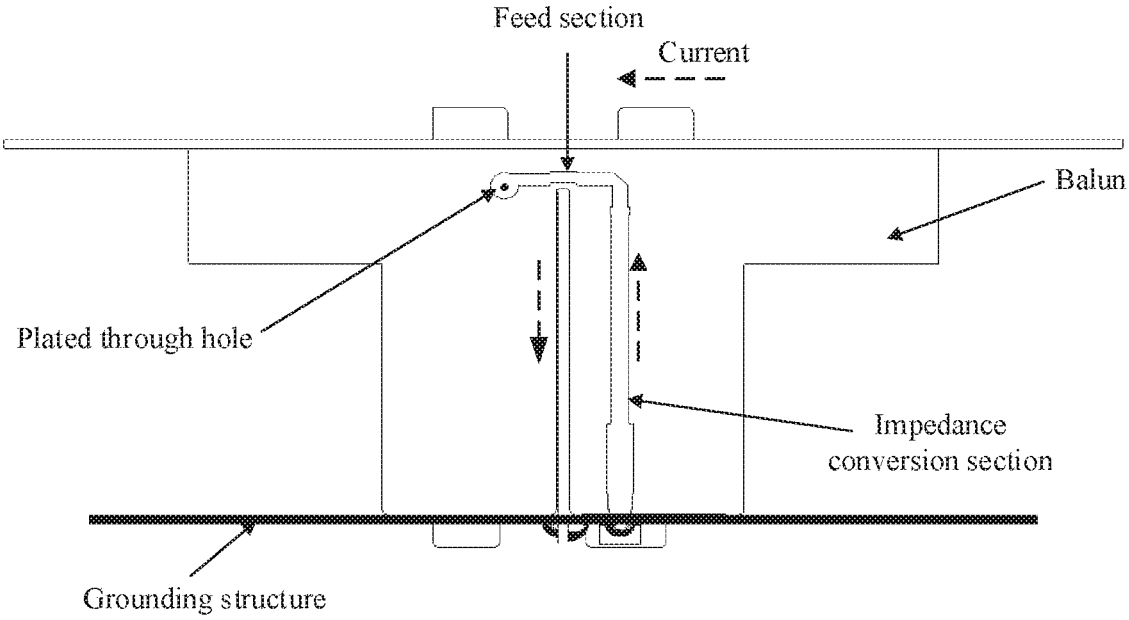
FIG. 8 is another schematic structural diagram of a first radiating element according to an embodiment of the present invention.

Specifically, the plated through hole is introduced to the transport layer of the feed signal, and the plated through hole and the microstrip are used as the conductive structure. The plated through hole may be disposed at a stub of the feed section. FIG. 8 is a schematic structural diagram when the plated through hole is disposed at the transport layer of the feed signal.

Correspondingly, the transport layer of the feed signal may be used to: after obtaining the differential mode signal, input the differential mode signal to the microstrip by using the plated through hole.

The microstrip is configured to input, to the grounding structure, the differential mode signal input from the transport layer of the feed signal. The differential mode signal flows from the transmission section and the feed section into the microstrip.

Specifically, when the plated through hole is disposed at the stub of the feed section, as shown in FIG. 8, on a left side of FIG. 8, the transport layer of the feed signal is directly electrically connected to the signal ground layer by using the plated through hole, and current flowing directions of the transport layer of the feed signal and the signal ground layer are consistent. On a right side of FIG. 8, the transport layer of the feed signal is connected, through coupling, to the signal ground layer by using a medium. It can be learned that currents at the transport layer of the feed signal and the signal ground layer are in a reverse phase. Solid line arrows on the right side of FIG. 8 indicate a current direction of the transport layer of the feed signal on a right side of the radiation arm, and dashed line arrows on the right side of FIG. 8 indicate a current direction of the signal ground layer on the right side of the radiation arm. In this case, for the high frequency signal, from the plated through hole used as a short circuit point, an impedance is infinite. However, for a low frequency signal obtained through sensing, because the plated through hole is disposed, a transmission path of the low-frequency induced current generated on the high-band radiating element is changed. Therefore, when obtaining, through sensing the low frequency signal, the high-band radiating element does not generate differential mode resonance that affects the low frequency signal.

Figure 10:
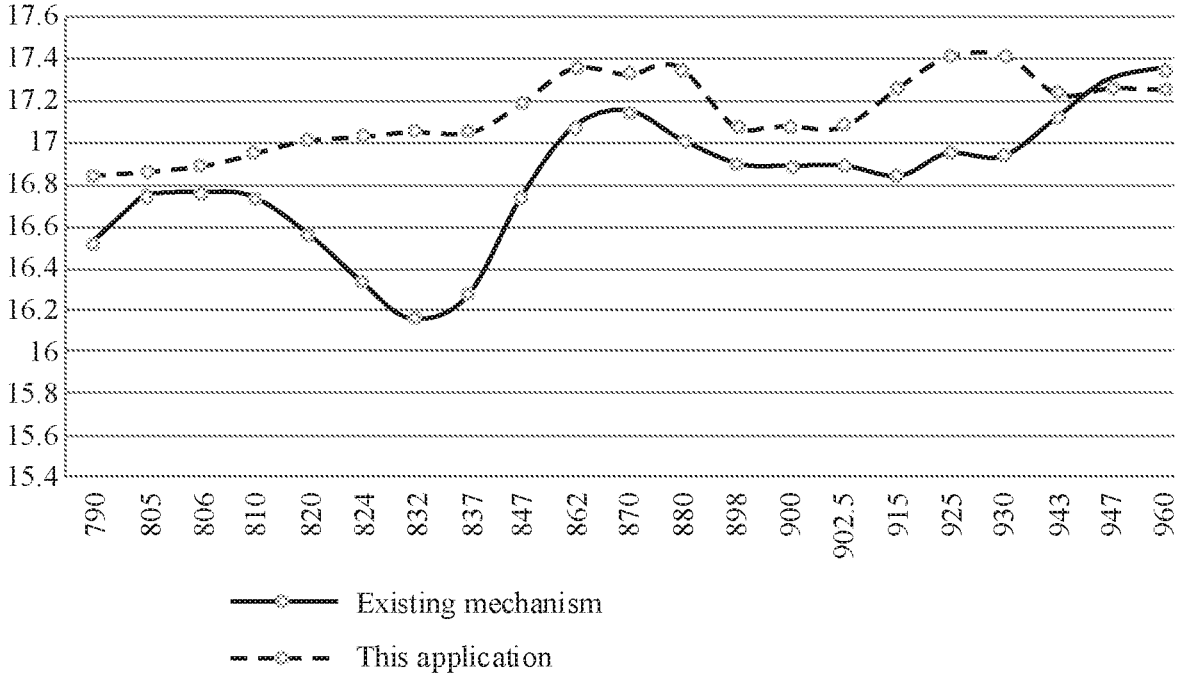

It can be learned that in any one of circuit structures shown in FIG. 5 to FIG. 8, after the first radiating element obtains, through sensing, the differential mode signal of the second radiating element, differential mode resonance formed due to the differential mode signal on the first radiating element can be destroyed. For the second radiating element, radiation that is generated when the second radiating element is operating receives significantly less radiation interference from the first radiating element, and even does not receive radiation interference from the first radiating element. In addition, a radiation gain of the second radiating element does not deteriorate due to differential mode resonance. In comparison with an existing mechanism, the radiation gain of the second radiating element can be significantly increased. For a specific schematic diagram of radiation gain comparison, refer to the curve diagram shown in FIG. 10. A dashed line in FIG. 10 is a radiation gain curve of the second radiating element when the balun structure in this application is not used. A solid line in FIG. 10 is a radiation gain curve of the second radiating element when the balun structure in this application is used. It may be learned from FIG. 10 that the radiation gain of the second radiating element is significantly increased.

Figure 9:
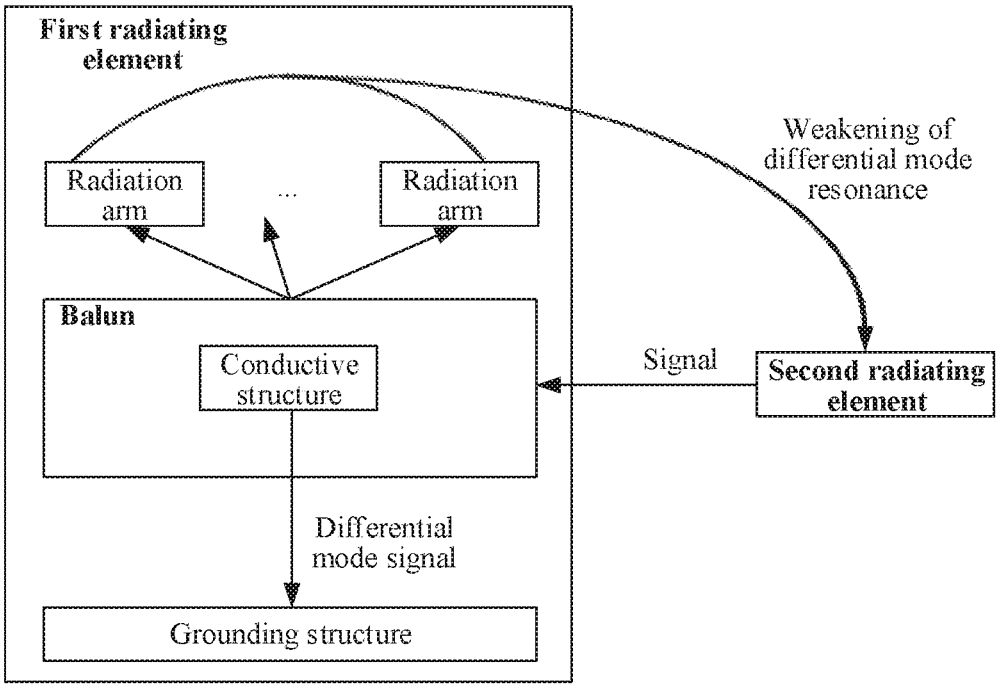
FIG. 9 is a schematic flowchart of a method for controlling inter-band interference in a multi-band antenna system according to an embodiment of the present invention; and FIG. It is a schematic diagram of a radiation gain curve according to an embodiment of the present invention.

The foregoing uses an example to describe the multi-band antenna system, and the following uses an example to describe a method for controlling inter-band interference in the multi-band antenna system in this application. As shown in FIG. 9, in this embodiment of the present invention, the multi-band antenna system includes at least one first radiating element and at least one second radiating element, and an operating frequency band of the first radiating element is higher than an operating frequency band of the second radiating element.

Each first radiating element includes a grounding structure, a balun, and at least two radiation arms. One end of the balun is electrically connected to the at least two radiation arms. The balun includes at least one conductive structure. For a schematic structural diagram of the multi-band antenna system, refer to any one of structures shown in FIG. 1, FIG. 2, and FIG. 5 to FIG. 8.

After the second radiating element sends a signal, if the first radiating element obtains, through sensing, the signal in a differential mode manner and obtains a differential mode signal, the first radiating element inputs the differential mode signal to the balun. After obtaining the differential mode signal, the balun transfers the differential mode signal to the grounding structure by using the at least one conductive structure. The differential mode signal is a signal obtained by the balun by sensing a signal from the second radiating element in a differential mode manner.

In the solution provided in this application, because the at least one conductive structure is disposed in the balun in the first radiating element, after obtaining the differential mode signal, the balun can input the differential mode signal to the grounding structure by using the at least one conductive structure. In this way, the differential mode signal does not flow into the radiation arm of the first radiating element. Correspondingly, the differential mode signal does not generate differential mode radiation between radiation arms of the first radiating element, so that inter-band interference can be reduced, and differential mode resonance intensity of the second radiating element within the operating frequency band of the second radiating element decreases. Therefore, it can be ensured that the first radiating element operates normally, and the second radiating element also operates normally. For a high-band radiating element, after obtaining a low frequency signal of a low-band radiating element, because the high-band radiating element uses the balun structure shown in FIG. 5 of this application, in other words, the high-band radiating element can block backflow of the low frequency signal between the radiation arms, the high-band radiating element finally eliminates the differential mode radiation caused by the low frequency signal. In this way, an antenna pattern of the low-band radiating element is not interfered, and a radiation gain of the low-band radiating element is further increased.

In this application, the balun further includes a transport layer of a feed signal, a signal ground layer, and a microstrip. Both the transport layer of the feed signal and the signal ground layer are electrically connected to the grounding structure. The transport layer of the feed signal is electrically connected to the signal ground layer, and the microstrip is electrically connected to the grounding stricture. The following two manners are mainly used to suppress differential mode resonance.

1. Introduce a Short-Circuit Stub to the Balun

When the conductive structure includes the short-circuit stub and the microstrip, the transport layer of the feed signal inputs the differential mode signal to the microstrip by using at least one short-circuit stub.

Then, the microstrip inputs, to the grounding structure, the differential mode signal input from the transport layer of the feed signal.

In this application, the transport layer of the feed signal includes an impedance conversion section and a coupling section. The impedance conversion section includes a transmission section and a feed section. In this application, a total quantity of deployed short-circuit stubs and a quantity of short-circuit stubs respectively deployed on the transmission section, the feed section, or the coupling section is not limited. The following describes deployment of a short-circuit stub.

(1) Dispose the Short-Circuit Stub on the Transmission Section.

When the at least one short-circuit stub is electrically connected to the transmission section, the differential mode signal flows from the transmission section and the feed section into the microstrip. FIG. 6*a* is a schematic structural diagram when the short-circuit stub is disposed on the transmission section. Dashed line arrows on a left side of the balun shown in FIG. 6*a* refer to a direction of the differential mode signal in the microstrip, and dashed line arrows on a right side of the balun shown in FIG. 6*a* refer to a direction of the differential mode signal in the impedance conversion section. Because the differential mode signal cannot generate a flowing-back induced current between radiation arms, for the radiation arm of the first radiating element, currents of two radiation arms are in a same direction. In addition, there is no induced current generated by a differential mode signal of another radiating element whose operating frequency band is higher than that of the first radiating element. Finally, the first radiating element does not cause differential mode resonance interference to a second radiating element whose operating frequency band is lower than that of the first radiating element, or receive differential mode resonance interference from a nearby radiating element whose operating frequency band is higher than that of the first radiating element.

(2) Dispose the Short-Circuit Stub on the Feed Section.

When the at least one short-circuit stub is electrically connected to the feed section, the differential mode signal flows from the feed section into the microstrip. FIG. 6*b* is a schematic structural diagram when the short-circuit stub is disposed on the feed section. Dashed line arrows on a left side of the balun shown in FIG. 6*b* refer to a direction of the differential mode signal in the microstrip, and dashed line arrows on a right side of the balun shown in FIG. 6*b* refer to a direction of the differential mode signal in the impedance conversion section.

(3) Dispose the Short-Circuit Stub on the Coupling Section.

When the at least one short-circuit stub is electrically connected to the coupling section, the differential mode signal flows from the coupling section and the feed section into the microstrip. FIG. 6*c* is a schematic structural diagram when the short-circuit stub is disposed on the coupling section. Dashed line arrows on a left side of the balun shown in FIG. 6*c* refer to a direction of the differential mode signal in the microstrip, and dashed line arrows on a right side of the balun shown in FIG. 6*c* refer to a direction of the differential mode signal in the impedance conversion section.

(4) Dispose the Short-Circuit Stub on at Least Two of the Transmission Section, the Feed Section, or the Coupling Section.

For example, the short-circuit stub is separately disposed on the transmission section and the coupling section (as shown in FIG. 6*d*), or the short-circuit stub is separately disposed on the feed section and the coupling section (as shown in FIG. 6*e*), or the short-circuit stub is separately disposed on the transmission section, the feed section, and the coupling section (as shown in FIG. 6*f*). For a specific trend of the differential mode signal, refer to the analysis process of the trend of the differential mode signal in the structures in (1) to (3). Specifically, in this circuit structure in (4), a signal trend of the differential mode signal may include at least one of the following three types:

The differential mode signal flows from the transmission section and the feed section into the microstrip.

Alternatively, the differential mode signal flows from the coupling section and the feed section into the microstrip.

Alternatively, the differential mode signal flows from the feed section into the microstrip.

B. Introduce the short-circuit stub to the transport layer of the feed signal, and use the short-circuit stub as the foregoing conductive structure.

One end of the short-circuit stub is electrically connected to the transport layer of the feed signal, and the other end of the short-circuit stub is electrically connected to the grounding structure.

The transport layer of the feed signal is used to: after obtaining the differential mode signal, divert the differential mode signal from the transport layer of the feed signal to the grounding structure by using at least one short-circuit stub, so that the differential mode signal cannot generate an induced current between the radiation arms of the first radiating element. In this way, differential mode resonance is not generated for the second radiating element, and a radiation gain of the second radiating element can be increased without a need to greatly modify an original balun structure and to reduce an entire integration level of the balun.

Likewise, in an embodiment in which the short-circuit stub is used as the conductive structure, and the differential mode signal is diverted to the grounding structure by using the short-circuit stub, the short-circuit stub may also be separately disposed on at least one of the transmission section, the feed section, or the coupling section. For a specific schematic structural diagram, refer to the structural diagrams shown in FIG. 7*a*, FIG. 7*b*, and FIG. 7*c*. In FIG. *a*, the short-circuit stub is disposed on the transmission section of the transport layer of the feed signal. In FIG. 7*b*, the short-circuit stub is disposed on the feed section of the transport layer of the feed signal. In FIG. 7*c*, the short-circuit stub is disposed on the coupling section of the transport layer of the feed signal.

Optionally, in some embodiments of the invention, an antenna element on the first radiating element is a half-wave dipole, to weaken impact on the differential mode resonance for the second radiating element, and ensure radiation efficiency of the first radiating element. Further, a length of the radiation arm of the first radiating element, a height of the balun of the first radiating element, or a length of the short-circuit stub may be set.

For example, the height of the balun may be Y, where Y=L/4, to enhance antenna performance of the first radiating element.

Alternatively, the length of the radiation arm is set to L/4, so that a total length of the two radiation arms is L/2, and maximum radiation efficiency can be finally implemented.

For example, the length of the short-circuit stub may alternatively be set to X, where X=n×(L/4), L is a wavelength corresponding to a center frequency of the operating frequency band of the first radiating element, and n is a positive integer less than or equal to 4. For example, when n=1, the length of the short-circuit stub is L/4, and the L/4 short-circuit stub considers impedance conversion of the transport layer of the feed signal. After L/4 conversion of the short-circuit stub on the entire transport layer of the feed signal, for a high frequency signal, the short-circuit stub of this length is equivalent to a short-circuit stub whose resistance is in a high resistance status, and is equivalent to an open circuit line. Therefore, a high-frequency differential mode signal cannot flow into the transport layer of the feed signal, but can only flow back between radiation arms at a top of the balun.

However, for a low frequency signal, the short-circuit stub is not an L/4 short circuit line. Therefore, when a low-frequency differential mode signal flows into the first radiating element, a resistance of an entire short-circuit stub decreases. Therefore, the low-frequency differential mode signal may flow to the grounding structure along the microstrip, instead of flowing into the radiation arm of the first radiating element, to further eliminate differential mode resonance.

2. Introduce a Plated Through Hole to the Balun

Specifically, the plated through hole is introduced to the transport layer of the feed signal, and the plated through hole and the microstrip are used as the conductive structure. The plated through hole may be disposed at a stub of the teed section. FIG. 8 is a schematic structural diagram when the plated through hole is disposed at the transport layer of the feed signal.

Correspondingly, after obtaining the differential mode signal, the transport layer of the feed signal inputs the differential mode signal to the microstrip by using the plated through hole.

Then, the microstrip inputs, to the grounding structure, the differential mode signal input from the transport layer of the feed signal. In the circuit structure shown in FIG. 8, the differential mode signal flows from the transmission section and the feed section into the microstrip.

Optionally, when the plated through hole is disposed at the stub of the feed section, as shown in FIG. 8, on a left side of FIG. 8, the transport layer of the feed signal is directly electrically connected to the signal ground layer by using the plated through hole, and current flowing directions of the transport layer of the feed signal and the signal ground layer are consistent. On a right side of FIG. 8, the transport layer of the teed signal is connected, through coupling, to the signal ground layer by using a medium. It can be learned that currents in the transport layer of the feed signal and the signal ground layer are in a reverse phase. Solid line arrows on the right side of FIG. 8 indicate a current direction of the transport layer of the feed signal on a right side of the radiation arm, and dashed line arrows on the right side of FIG. 8 indicate a current direction of the signal ground layer on the right side of the radiation arm. In this case, for the high frequency signal, from the plated through hole used as a short circuit point, an impedance is infinite. However, for a low frequency signal obtained through sensing, because the plated through hole is disposed, a transmission path of the low-frequency induced current generated on the high-band radiating element is changed. Therefore, when obtaining, through sensing the low frequency signal, the high-band radiating element does not generate differential mode resonance that affects the low frequency signal.

It can be learned that in any one of circuit structures shown in FIG. 5 to FIG. 8, after the first radiating element obtains, through sensing, the differential mode signal of the second radiating element, differential mode resonance formed due to the differential mode signal on the first radiating element can be destroyed. For the second radiating element, radiation that is generated when the second radiating element is operating receives significantly less radiation interference from the first radiating element, and even does not receive radiation interference from the first radiating element. In addition, a radiation gain of the second radiating element does not deteriorate due to differential mode resonance. In comparison with an existing mechanism, the radiation gain of the second radiating element can be significantly increased. For a specific schematic diagram of radiation gain comparison, refer to the curve diagram shown in FIG. 10. A dashed line in FIG. 10 is a radiation gain curve of the second radiating element when the balun structure in this application is not used. A solid line in FIG. 10 is a radiation gain curve of the second radiating element when the balun structure in this application is used. It may be learned from FIG. 10 that the radiation gain of the second radiating element is significantly increased.

Optionally, in some embodiments of the invention, if a signal sent on at least one low frequency band is received on a plurality of high frequency bands at a same time, in other words, a plurality of first radiating elements receive, at a same time, a signal sent by at least one second radiating element, for a process of processing the signal on each high-band radiating element, refer to description of the first radiating element in the foregoing embodiment. Details are not described herein. For an entire multi-band antenna system, a total effect generated is a sum of superposed vectors. To be specific, a low-band element is first placed, and a differential mode resonance suppression procedure (a differential mode resonance suppression procedure of the first radiating element) is performed on each high-band element in the multi-band antenna system. However, induced current intensity of each high-band radiating element may be different (induced current intensity is inversely proportional to a square of a distance, for example, a longer distance indicates weaker induced current intensity). If low-band radiating elements are deployed in different places, induced current intensity on a high-band radiating element near the low-band radiating element also changes, and a change principle is consistent. Finally, for a specific high-band radiating element, when a plurality of low-band radiating elements are deployed around the high-band radiating element, induced current generated on the high-band radiating element is equal to a vector sum of induced currents generated when each low frequency band exists individually. In the foregoing embodiments, the description of all embodiments has respective focuses. For a part that is not described in detail in an embodiment, refer to related description in another embodiment.

It may be clearly understood by a person skilled in the art that, for convenient and brief description, for a specific working process of the foregoing system, apparatus, and module, refer to a corresponding process in the foregoing method embodiments. Details are not described herein again.

In the several embodiments provided in this application, it should be understood that the disclosed system, apparatus, and method may be implemented in other manners. For example, the described apparatus embodiment is merely an example. For example, the module division is merely logical function division and may be other division during actual implementation. For example, a plurality of modules or components may be combined or integrated into another system, or some features may be ignored or not performed. In addition, the displayed or discussed mutual couplings or direct couplings or communication connections may be implemented through some interfaces. The indirect couplings or communication connections between the apparatuses or modules may be implemented in electronic, mechanical, or other forms.

The modules described as separate parts may or may not be physically separate, and parts displayed as modules may or may not be physical modules, may be located in one position, or may be distributed on a plurality of network modules. Some or all the modules may be selected based on an actual requirement to achieve the objectives of the solutions of the embodiments.

In addition, functional modules in the embodiments of this application may be integrated into one processing module, or each of the modules may exist alone physically, or two or more modules are integrated into one module. The integrated module may be implemented in a form of hardware, or may be implemented in a form of a software functional module. When the integrated module is implemented in the form of the software functional module and sold or used as an independent product, the integrated module may be stored in a computer-readable storage medium.

All or some of the foregoing embodiments may be implemented by using software, hardware, firmware, or any combination thereof. When the embodiments are implemented by using software, all or some of the embodiments may be implemented in a form of a computer program product.

The computer program product includes one or more computer instructions. When the computer program instruction is loaded and executed on a computer, the procedure or function according to the embodiments of the present invention are all or partially generated. The computer may be a general-purpose computer, a dedicated computer, a computer network, or another programmable apparatus. The computer instructions may be stored in a computer-readable storage medium or may be transmitted from one computer-readable storage medium to another computer-readable storage medium. For example, the computer instruction may be transmitted from one website, computer, server, or data center to another website, computer, server, or data center in a wired (for example, a coaxial cable, an optical fiber, or a digital subscriber line (DSL)) or wireless (for example, infrared, radio, or microwave) manner. The computer-readable storage medium may be any usable medium accessible by a computer, or a data storage device, such as a server or a data center, integrating one or more usable media. The usable medium may be a magnetic medium (for example, a floppy disk, a hard disk, or a magnetic tape), an optical medium (for example, a DVD), a semiconductor medium (for example, a solid-state drive Solid State Disk (SSD)), or the like.

The technical solutions provided in this application are described in detail above. The principle and implementation of this application are described herein by using specific examples. The description about the embodiments is merely provided to help understand the method and core ideas of this application. In addition, a person of ordinary skill in the art can make variations and modifications to this application in terms of the specific implementations and application scopes based on the ideas of this application. Therefore, the content of specification shall not be construed as a limit to this application.

What is claimed is:

1. A multi-band antenna system, comprising:

at least one first radiating element; and at least one second radiating element, wherein an operating frequency band of the first radiating element is higher than an operating frequency band of the second radiating element;

wherein each of the at least one first radiating element comprises a grounding structure, a balun, and at least two radiation arms, wherein one end of the balun is electrically connected to the at least two radiation arms, and the balun comprises at least one conductive structure; and wherein the balun is configured to: after obtaining a differential mode signal, input the differential mode signal to the grounding structure using the at least one conductive structure, wherein the differential mode signal is a signal obtained by the balun by sensing a signal from the second radiating element in a differential mode manner.

2. The antenna system according to claim 1, wherein the balun further comprises a transport layer of a feed signal, wherein:

the conductive structure comprises a short-circuit stub and a microstrip, the microstrip is electrically connected to the grounding structure, the transport layer of the feed signal is used to: after obtaining the differential mode signal, input the differential mode signal to the microstrip using at least one short-circuit stub; and the microstrip is configured to input, to the grounding structure, the differential mode signal input from the transport layer of the feed signal.

3. The antenna system according to claim 2, wherein:

the transport layer of the feed signal comprises an impedance conversion section, the impedance conversion section comprises a transmission section and a feed section, and when the at least one short-circuit stub is electrically connected to the transmission section, the differential mode signal flows from the transmission section and the feed section into the microstrip; or when the at least one short-circuit stub is electrically connected to the feeding section, the differential mode signal flows from the feeding section into the microstrip.

4. The antenna system according to claim 2, wherein:

the transport layer of the feed signal comprises an impedance conversion section and a coupling section, the impedance conversion section comprises a feed section, the at least one short-circuit stub is electrically connected to the coupling section, and the differential mode signal flows from the coupling section and the feed section into the microstrip.

5. The antenna system according to claim 2, wherein:

the transport layer of the feed signal comprises an impedance conversion section and a coupling section, the coupling section and the impedance conversion section each are electrically connected to the at least one short-circuit stub, the impedance conversion section comprises a transmission section and a feed section, and the differential mode signal flows from the transmission section and the feed section into the microstrip; or the differential mode signal flows from the coupling section and the feed section into the microstrip; or the differential mode signal flows from the feed section into the microstrip.

6. The antenna system according to claim 2, wherein a length of the short-circuit stub is X, $X=n\times(L/4)$, L is a wavelength corresponding to a center frequency of the operating frequency band of the first radiating element, and n is a positive integer less than or equal to 4.

7. The antenna system according to claim 1, wherein:

the balun further comprises a transport layer of a feed signal, the conductive structure comprises a short-circuit stub, one end of the short-circuit stub is electrically connected to the transport layer of the feed signal, and the other end of the short-circuit stub is electrically connected to the grounding structure; and the transport layer of the feed signal is used to: after obtaining the differential mode signal, divert the differential mode signal from the transport layer of the feed signal to the grounding structure by using the at least one short-circuit stub.

8. The antenna system according to claim 1, wherein:

the balun further comprises a transport layer of a feed signal, the conductive structure comprises a microstrip and a plated through hole, the plated through hole is disposed at a stub of a feed section, the microstrip is electrically connected to the grounding structure, the transport layer of the feed signal is configured to: after obtaining the differential mode signal from the second radiating element, input the differential mode signal to the microstrip using the plated through hole, and the microstrip is configured to input, to the grounding structure, the differential mode signal input from the transport layer of the feed signal.

9. The antenna system according to claim 8, wherein the transport layer of the feed signal comprises an impedance conversion section, the impedance conversion section comprises a transmission section and the feed section; and the differential mode signal flows from the transmission section and the feed section into the microstrip.

10. The antenna system according to claim 9, wherein a height of the balun is Y, and Y=L/4.

11. A method for controlling inter-band interference in a multi-band antenna system, wherein the multi-band antenna system comprises at least one first radiating element and at least one second radiating element, and an operating frequency band of the first radiating element is higher than an operating frequency band of the second radiating element; and wherein each of the at least one first radiating element comprises a grounding structure, a balun, and at least two radiation arms, one end of the balun is electrically connected to the at least two radiation arms, and the balun comprises at least one conductive structure; and the method comprises:

after obtaining a differential mode signal, transferring, by the balun, the differential mode signal to the grounding structure using the at least one conductive structure, wherein the differential mode signal is a signal obtained by the balun by sensing a signal from the second radiating element in a differential mode manner.

12. The method according to claim 11, wherein the balun further comprises a transport layer of a feed signal, the conductive structure comprises a short-circuit stub and a microstrip, and the microstrip is electrically connected to the grounding structure; and the transferring the differential mode signal to the grounding structure using the at least one conductive structure comprises:

inputting, by the transport layer of the feed signal, the differential mode signal to the microstrip using the at least one short-circuit stub; and inputting, by the microstrip to the grounding structure, the differential mode signal input from the transport layer of the feed signal.

13. The method according to claim 12, wherein the transport layer of the feed signal comprises an impedance conversion section, and the impedance conversion section comprises a transmission section and a feed section; and when the at least one short-circuit stub is electrically connected to the transmission section, the differential mode signal flows from the transmission section and the feed section into the microstrip; or when the at least one short-circuit stub is electrically connected to the feed section, the differential mode signal flows from the feed section into the microstrip.

14. The method according to claim 12, wherein the transport layer of the feed signal comprises an impedance conversion section and a coupling section, the impedance conversion section comprises a feed section, and the at least one short-circuit stub is electrically connected to the coupling section; and the differential mode signal flows from the coupling section and the feed section into the microstrip.

15. The method according to claim 12, wherein the transport layer of the feed signal comprises an impedance conversion section and a coupling section, the coupling section and the impedance conversion section each are electrically connected to the at least one short-circuit stub, and the impedance conversion section comprises a transmission section and a feed section; and the differential mode signal flows from the transmission section and the feed section into the microstrip; or the differential mode signal flows from the coupling section and the feed section into the microstrip; or the differential mode signal flows from the feed section into the microstrip.

16. The method according to claim 12, wherein a length of the short-circuit stub is X, X=n×(L/4), L is a wavelength corresponding to a center frequency of the operating frequency band of the first radiating element, and n is a positive integer less than or equal to 4.

17. The method according to claim 11, wherein the balun further comprises a transport layer of a feed signal, the conductive structure comprises a short-circuit stub, one end of the short-circuit stub is electrically connected to the transport layer of the feed signal, and the other end of the short-circuit stub is electrically connected to the grounding structure; and the transferring the differential mode signal to the grounding structure using the at least one conductive structure comprises:

after obtaining the differential mode signal, diverting, by the transport layer of the feed signal, the differential mode signal from the transport layer of the feed signal to the grounding structure using the at least one short-circuit stub.

18. The method according to claim 11, wherein the balun further comprises a transport layer of a feed signal, the conductive structure comprises a microstrip and a plated through hole, the plated through hole is disposed at a stub of a feed section, and the microstrip is electrically connected to the grounding structure; and the transferring the differential mode signal to the grounding structure using the at least one conductive structure comprises:

after obtaining the differential mode signal, inputting, by the transport layer of the feed signal, the differential mode signal to the microstrip using the plated through hole; and inputting, by the microstrip to the grounding structure, the differential mode signal input from the transport layer of the feed signal.

19. The method according to claim 18, wherein the transport layer of the feed signal comprises an impedance conversion section, the impedance conversion section comprises a transmission section and the feed section, and the plated through hole is disposed at the stub of the feed section; and the differential mode signal flows from the transmission section and the feed section into the microstrip.

* * * * *